United States Patent [19]

Fujishita et al.

[11] Patent Number: 4,503,810

[45] Date of Patent: Mar. 12, 1985

[54] WATER HEATER

[75] Inventors: Kazuo Fujishita, Yamatokoriyama; Hideki Kaneko, Ikoma; Yoshiyuki Ushirokajitani; Tadao Kanno, both of Nara, all of Japan

[73] Assignee: Matsushita Electric Industrial Co., Ltd., Osaka, Japan

[21] Appl. No.: 465,870

[22] PCT Filed: May 27, 1982

[86] PCT No.: PCT/JP82/00201

§ 371 Date: Jan. 24, 1983

§ 102(e) Date: Jan. 24, 1983

[87] PCT Pub. No.: WO82/04304

PCT Pub. Date: Dec. 9, 1982

[30] Foreign Application Priority Data

May 28, 1981 [JP] Japan ..... 56-82252
May 28, 1981 [JP] Japan ..... 56-82253
Jun. 18, 1981 [JP] Japan ..... 56-95034

[51] Int. Cl.[3] ..... F22B 5/00

[52] U.S. Cl. ..... 122/13 R; 126/362; 122/18

[58] Field of Search ..... 122/13 R, 17, 18, 19, 122/14; 126/350 R, 361, 362; 219/297, 306, 314; 237/19; 236/23, 24

[56] References Cited

U.S. PATENT DOCUMENTS

| | | | |
|---|---|---|---|
| Re. 12,397 | 11/1905 | Deasy | 126/350 R X |
| 243,680 | 7/1881 | Austin | 126/362 |
| 299,740 | 6/1884 | Clark | 126/362 X |
| 591,098 | 10/1897 | Graves | 122/13 R |
| 1,050,911 | 1/1913 | Boland | 122/13 R |
| 1,421,692 | 11/1921 | Hutchins | 126/350 R |
| 2,814,279 | 11/1957 | Thomas | 122/18 |
| 4,027,821 | 6/1977 | Hayes | 126/362 |
| 4,155,506 | 5/1979 | Brosenius | 126/362 X |

FOREIGN PATENT DOCUMENTS

| | | |
|---|---|---|
| 11221 | 4/1925 | Japan . |
| 21277 | 9/1962 | Japan . |

*Primary Examiner*—Henry C. Yuen
*Attorney, Agent, or Firm*—Wenderoth, Lind & Ponack

[57] ABSTRACT

This invention is a water heater wherein a heat source is located outside a hot water storage tank and high temperature hot water can be distributed between the regions of the hot water storage tank above and below the middle thereof, reducing loss of heat through dissipation and preparing high temperature hot water at uniform temperature in a short time upon depletion of the hot water.

2 Claims, 11 Drawing Figures

Fig. 10
PRIOR ART
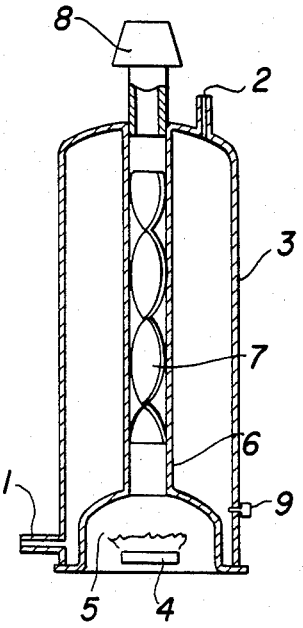
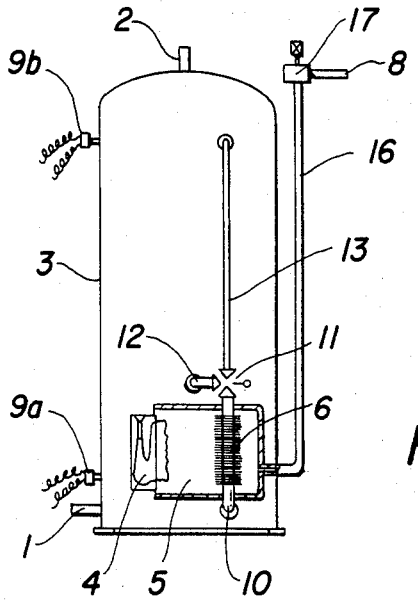
Fig. 1

SMALL QUANTITY HEATING PERFORMANCE DIAGRAM

SMALL QUANTITY HEATING TAPPING PERFORMANCE DIAGRAM

HEAT DISSIPATION PERFORMANCE DIAGRAM

WATER HEATER

BACKGROUND OF THE INVENTION

Technical Field

This invention relates to a water heater of the hot water storage type having a firing section installed outside a hot water storage tank, the water heater being designed to store hot water in large and small amounts, selectively, to make it possible to store hot water in amounts agreeing with the size of demands for hot water.

Description of the Prior Art

A conventional water heater is constructed in the manner shown in FIG. 10. A hot water storage tank 3, having a cold water in feed pipe 1 in the lower region, and a hot water out feed pipe 2 in the upper region, defines a combustion chamber 5 internally in the bottom which is capable of receiving a burner 4 forming the principal element of the heat source, said combustion chamber 5 communicating with a flue and heat exchanger 6 disposed in the middle and extending through the upper end. This water heater is of the natural draft combustion type wherein said flue and heat exchanger 6 has a large diameter and is provided with a baffler 7 to increase thermal efficiency, and an exhaust top 8 at the upper top end. The temperature of hot water in the hot water storage tank 3 is controlled by a temperature thermistor 9 serving to turn on and off the burner 4. Generally, in such a water heater the input to the heat source is low (e.g., 5,000–10,000 Kcal/h) and the hot water storage capacity is high (e.g., 200–400 l). Thus, the operation sequence allowing for the requirement of a long time to heat a predetermined amount of water to a predetermined temperature is such that the gas is ignited sufficiently before the time hot water is actually used in order to store hot water at high temperature (e.g., 80°–85° C.) in large amounts (e.g., 200–400 l). Supplementary heating is automatically effected in response to the lowering of the temperature of the hot water below a predetermined level, so that a large amount of hot water at high temperature will be obtained at any time.

This arrangement is of the type wherein gas is burned under natural draft and water is heated through the flue and heat exchanger 6. Thus, the phenomenon of cold air ascending under the action of draft during storage of hot water at high temperature in large amounts causes the incessant lowering of the temperature of the stored water. That is, the maintenance cost is very high because of high discharge heat loss (generally 400–500 Kcal/h) and the necessity of keeping a large amount of hot water in the storage tank at high temperature even if the demand for hot water is small (which means that hot water not being used loses its heat).

Another drawback is that the low input to the heat source 4 and the large capacity of the hot water storage tank 3 prolong the time required to re-prepare hot water if all the hot water in storage is used up in a short time.

SUMMARY OF INVENTION

The present invention eliminates such drawbacks. Thus, a first object of the invention is to separate from the hot water storage tank the heat source consisting mainly of a burner and a heat exchanger in order to minimize loss of heat through dissipation from the hot water storage tank caused by the action of natural draft.

A second object is to enable a single hot water storage tank to store a large amount (full load) and a small amount (e.g., 40–50 l) depending upon the size of demand for hot water so as to minimize loss of heat through dissipation, thereby minimizing maintenance cost while retaining the advantage of obtaining hot water at high temperature in amounts corresponding to needs.

A third object is to enable a small amount of hot water to be stored by a water heater which has a large water storage capacity, so as to make it possible to obtain in a short time a small amount of high temperature hot water uniform in tapping temperature and to promote convenience for use.

A fourth object is to provide an arrangement for re-heating hot water during tapping as well as for preparing hot water, by means of a single heat source, thereby permitting the lowering to the preset temperature of hot water in the hot water storage tank and hence achieving reduction of loss of heat through dissipation from the hot water storage tank.

BRIEF DESCRIPTION OF DRAWINGS

FIG. 1 is an external view of a water heater according to an embodiment of the present invention;

FIG. 10 is a sectional view of a conventional example and

BEST MODE OF CARRYING OUT THE INVENTION

Figure 11:
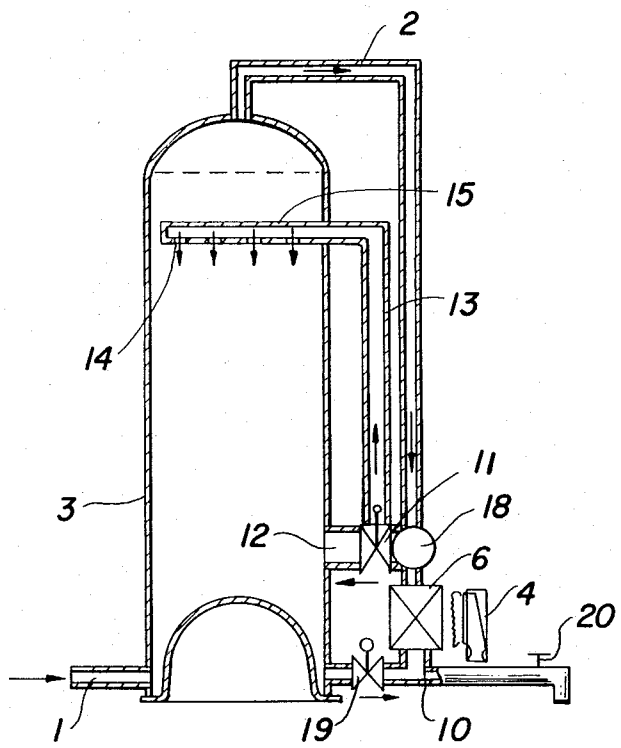
FIG. 11 is an internal view of the embodiment of the invention shown in FIG. 8.
Figure 2:
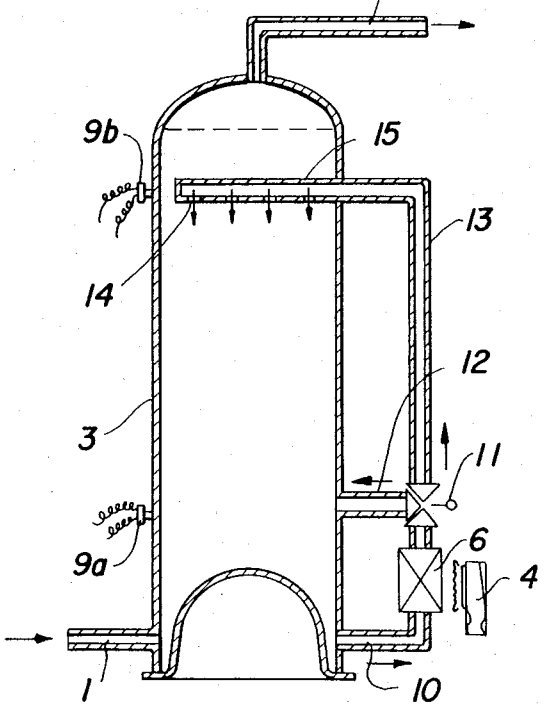
FIG. 2 is an internal view of one alternative of the embodiment.

An embodiment of the present invention will now be described with reference to FIGS. 1 through 3, where the same parts as those in FIG. 10 are indicated by the same numerals.

In the figures, an inlet pipe 10, a heat exchanger 6 and a switching valve 11 are arranged in the order mentioned as seen from the bottom of a hot water storage tank 3. The switching valve 11 connects one outlet pipe 12 to approximately below the middle of the hot water storage tank 3 and the other outlet pipe 13 to approximately above the middle. The outlet pipe 13 is provided with a spray pipe 15 extending horizontally into the hot water storage tank 3 and being similar in cross section to a bar or ring, said spray pipe 15 being closed at its front end and having a plurality of small holes 14.

The heat source is composed of said heat exchanger 6, a burner 4, and a combustion chamber 5 and communicates with a combustion fan 17 through a flue 16 of small diameter, leading to an exhaust top 8. Further, a temperature thermistor 9*b* is installed on the lateral wall of the hot water storage tank 3 and disposed below the spray pipe 15, and a temperature thermistor 9*a* is disposed below the outlet pipe A 12.

Figure 4:
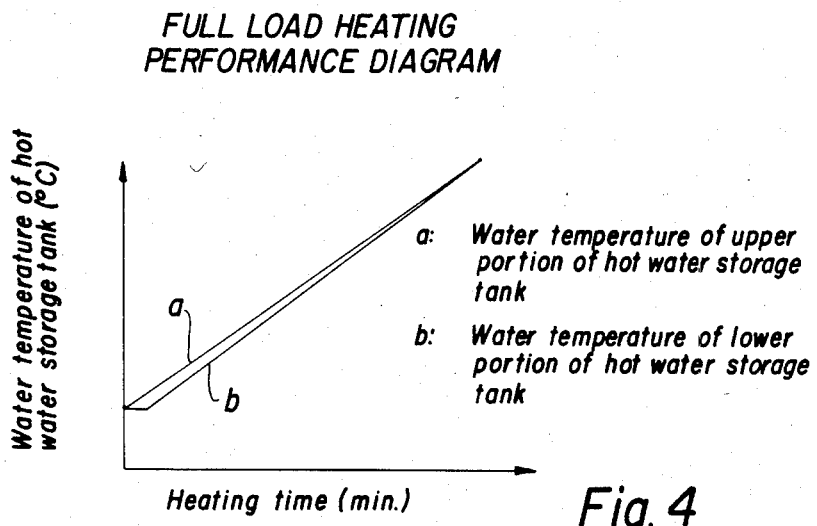
FIG. 4 is a full load heating performance diagram.
Figure 5:
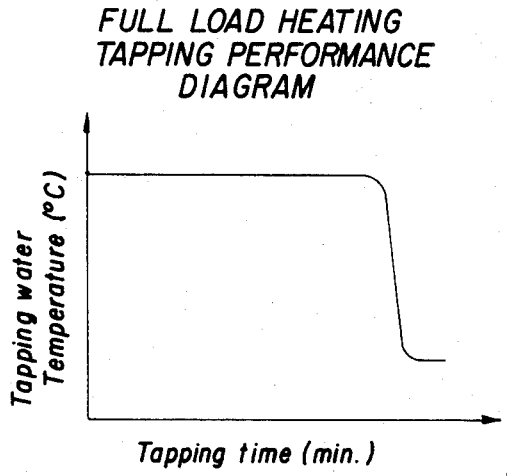
FIG. 5 is a tapping performance diagram associated with full load heating.

In the arrangement described above, where the full load (large quantity) is to be heated for storage in the hot water storage tank 3, the high temperature hot water heated by the heat exchanger 6 is switched by the switching valve 11 to the outlet pipe A 12 and then into the hot water storage tank 3 through the region approximately below the middle thereof. In this case, since the rate of natural convection of the hot water in the hot water storage tank 3 is very low, the heating of the water in the tank 3 is uniform so that the temperature of the water increases steadily, as shown in FIG. 4, and the temperature of hot water being tapped is also uniform (as shown in FIG. 5).

The operation in this case controls the temperature of hot water by turning on and off the burner in the heat source by the temperature thermistor 9*a* installed in the lower region of the hot water storage tank. That is, for full load heating, the outlet pipe 12 is associated with the temperature thermistor 9*a*.

Figure 6:
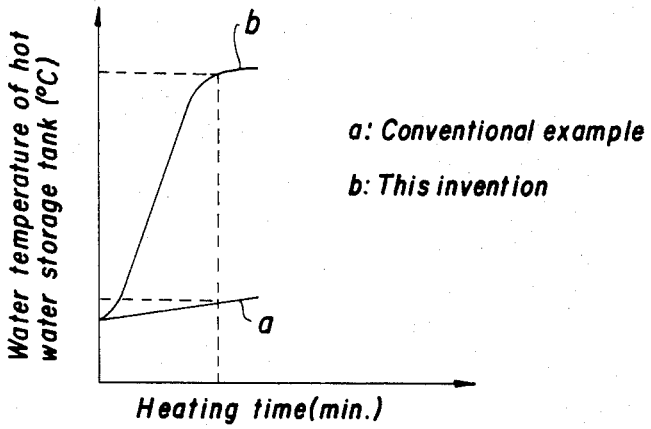
FIG. 6 is a diagram showing small-quantity heating performance and the performance of a conventional example.
Figure 7:
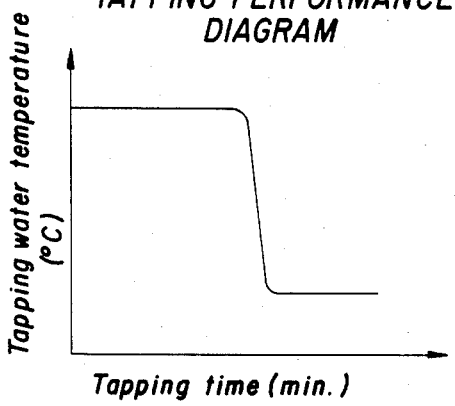
FIG. 7 is a digram showing tapping performance associated with small-quantity heating.

On the other hand, when a small amount of hot water is to be prepared in the hot water storage tank 3, the high temperature hot water heated by the heat exchanger 6 is led to the outlet pipe 13 by the switching valve 11, so that it is fed in while being finely divided through the small holes 14 in the spray pipe 15 installed approximately above the middle of the hot water storage tank 3. As for the performance of the small quantity storage operation, high temperature hot water can be obtained in a short time and the temperature of the hot water is constant. The spraying method used in this embodiment satisfies said performance. More particularly, in the case where high temperature hot water from the outlet pipe 13 is concentratedly fed into the hot water storage tank 3 through one lateral wall thereof, the resulting unevenness of heat transfer in the hot water storage tank 3, though being capable of providing high temperature hot water in a short time, fails to ensure that the temperature of the hot water is uniform. In contrast, the illustrated embodiment of the invention realizes uniformity of temperature by spraying high temperature hot water in the hot water storage tank 3 to avoid unevenness of heat transfer and by downwardly spraying high temperature hot water so as to lessen the upward draft force of a high temperature hot water column in the hot water storage tank 3. In this case, one spray pipe 15 having a bar-like cross-section may be used, but another spray pipe 15 having a ring-like cross-section will provide improved uniformity of heat transfer. Performance during small quantity heating is shown in FIG. 6 and performance during small quantity tapping is shown in FIG. 7.

The operation in this case controls the temperature of the hot water by turning on and off the burner 4 of the heat source by the temperature thermistor 9*b* installed approximately above the middle of the hot water storage tank 3. That is, for small-quantity heating, the outlet pipe 13 is associated with the temperature thermistor 9*b*.

In this embodiment, if heating for hot water storage at full load is controlled by the temperature thermistor 9*b* installed approximately above the middle of the hot water storage tank 3, where hot water is required in amounts larger than one full load, it is necessary to heat a full load again by automatic supplementary heating. In order to obtain a larger amount of hot water than one full load of the tank 3, it is insufficient to use the temperature thermistor 9*b* alone, it being necessary to use a plurality of temperature thermistors projecting into the tank 3 in order to turn on and off the burner 4, thus controlling the heating temperature of the hot water storage tank 3.

While this embodiment has been described with reference to the arrangement wherein switching between the outlet pipes 12 and 13 is effected by the switching valve 11, there may be contemplated another embodiment which is in the form of a combination of the outlet pipe 13 and a solenoid valve installed in the outlet pipe 12. In this case, the outlet pipe A should be large in diameter and the outlet pipe 13 small in diameter. For full-load heating, the outlet pipe 12 with the solenoid valve opened and the outlet pipe 13 will be used, but a differential resistance should be provided as in the above so that almost all will flow out of the outlet pipe 12. Further, for small-load heating, the solenoid valve in the outlet pipe 12 should be closed because of the need to obtain high temperature hot water in a short time. Thus, with such a combination wherein the resistances of the solenoid valve and outlet pipes 12 and 13 are suitably selected, the object can be attained with substantially the same degree of performance.

Figure 3:
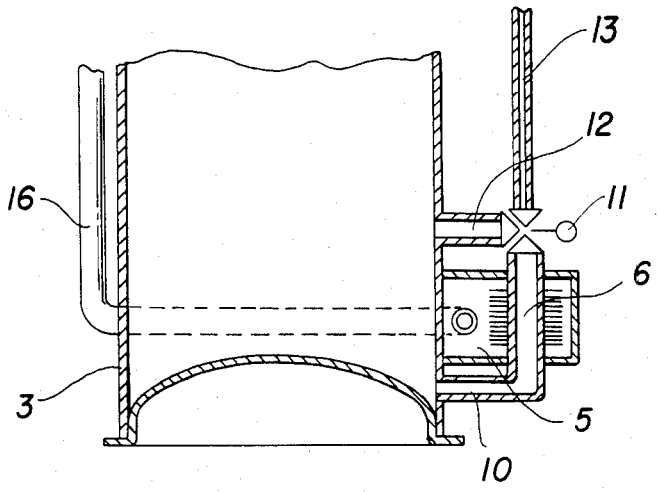
FIG. 3 is a fragmentary sectional view of the lower portion of the same embodiment.

In the present invention, the heat source is located outside the hot water storage tank 3, but as can be seen in the embodiment shown in FIG. 3, by installing the heat source directly on the lateral wall of the hot water storage tank 3, thermal efficiency is increased by the effective use of the radiant heat from the burner (with part of the hot water storage tank 3 serving as a heat transfer surface) and the construction of the heat source is simplified.

As described above, the arrangement of the invention makes it possible to allot time zones having small demands for hot water to storing hot water in small amounts and time zones having large demands for hot water to storing hot water at full load (large amounts). Thus, an operation sequence is possible which allots a period of time from midnight to early morning to storing hot water in small amounts, thereby minimizing loss of heat through dissipation. In other words, it is possible to store hot water in amounts corresponding to the varying size of demands for hot water.

Figure 8:
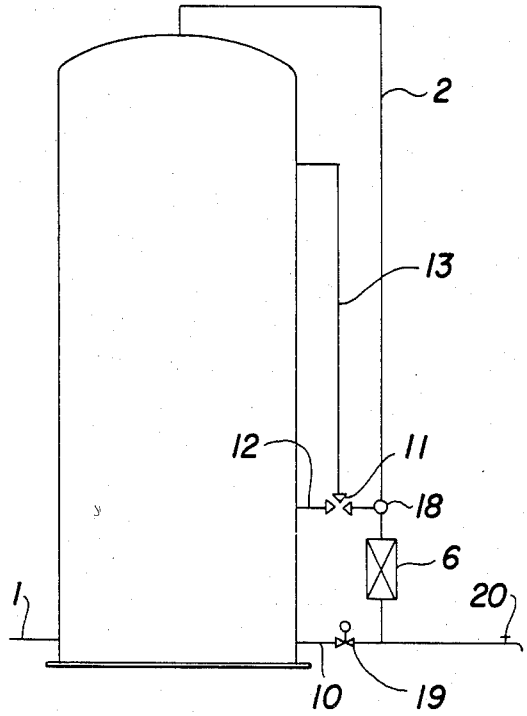
FIG. 8 is an external view of another embodiment of the invention.

Further, in the present invention, an arrangement may be contemplated wherein, in order to reduce loss of heat through dissipation, the heating temperature of hot water in the hot water storage tank 3 (hot water storage temperature) is reduced (e.g., to 60°–65° C.) and is reheated by the heat source during tapping, so that hot water at the same temperature as in the conventional water heater (e.g., 80°–85° C.) is obtained. Such an arrangement, as shown in FIG. 8, may comprise a second switching valve 18 installed on the outlet side of a heat exchanger 6, one end of said second valve 18 being connected to the first switching valve 11 and the other end to a hot water in feed pipe 2, a solenoid valve 19 installed in the inlet pipe 10, and a tapping circuit 20 extending from the solenoid valve 19 and bypassing the heat exchanger 6, wherein during heating, the solenoid valve 19 is opened and the tapping circuit 20 is closed so that water is switched through the first switching valve 11 by the second switching valve 18. During opening of the circuit 20, the solenoid valve 19 is closed and water is switched from the hot water feed pipe 2 by the second switching valve 18 out through the tapping circuit 20.

Figure 9:
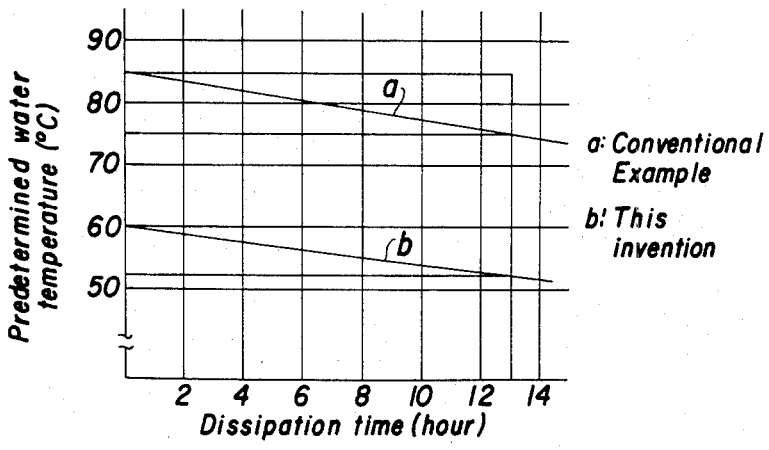
FIG. 9 is a heat dissipation performance diagram for the same.

As shown in FIG. 9, this arrangement makes it possible to reduce loss of heat through dissipation from the hot water storage tank 3.

INDUSTRIAL APPLICABILITY

As has been described so far, according to the invention, the heat source is located outside the hot water storage tank 3 and it is possible to store hot water in large and small amounts in the hot water storage tank 3 to meet demands for varying amounts of hot water, thus reducing loss of heat through dissipation, and hot water at high uniform temperature can be obtained in a short time if the hot water in the tank 3 is used up.

What is claimed is:

1. A water heater comprising:

a hot water storage tank having a lower region, an upper region, and a lateral wall;

a cold water infeed pipe in the lower region of the hot water storage tank;

a hot water outfeed pipe in the upper region of the hot water storage tank;

a heat source located outside the hot water storage tank;

a burner arranged in the heat source;

a heat exchanger arranged in the heat source and having an inlet side and an outlet side;

an inlet pipe connected between the inlet side of the heat exchanger and the lower region of the hot water storage tank;

a first switching valve installed on the outlet side of the heat exchanger;

an upper outlet pipe connected to the first switching valve at one end and extending into the upper region of the hot water storage tank at its other end;

a spray pipe connected to the other end of the upper outlet pipe, said spray pipe being closed at its front end and having a plurality of small holes spaced along its length and directed downwardly, said spray pipe also having a bar-like or a ring-like cross-section;

a lower outlet pipe connected to the first switching valve at one end and extending into the lower region of the hot water storage tank at its other end; and first and second temperature thermistors installed on the lateral wall of the hot water storage tank to turn on and off the burner to control the heating temperature for the hot water storage tank, wherein the first temperature thermistor is disposed in the lower region of the hot water storage tank and the second temperature thermistor is disposed in the upper region of the hot water storage tank, said lower and upper outlet pipes being associated with the first and second temperature thermistors, respectively, wherein the first switching valve is controlled and switched to select either the upper outlet pipe or the lower outlet pipe for high temperature hot water to pass through, depending upon whether either a full load or a small quantity of hot water is needed, respectively.

2. A water heater as set forth in claim 1, wherein the heat source is disposed directly on the lateral wall of a lower portion of the hot water storage tank.

* * * * *